United States Patent [19]

Tafel et al.

[11] Patent Number: 4,821,973

[45] Date of Patent: Apr. 18, 1989

[54] APPARATUS AND METHOD FOR ACTIVATING A DEVICE FOR OPERATING ON A MOVING WORKPIECE

[75] Inventors: Leonard I. Tafel, Mount Prospect; Leonard W. Kosoglad, Lincolnwood, both of Ill.

[73] Assignee: Webquip Corporation, Wheeling, Ill.

[21] Appl. No.: 112,276

[22] Filed: Oct. 26, 1987

Related U.S. Application Data

[62] Division of Ser. No. 918,481, Oct. 14, 1986, Pat. No. 4,729,519.

[51] Int. Cl.[4] ..... B65H 19/18; B65H 19/20

[52] U.S. Cl. ..... 242/57; 242/58.3; 83/359; 83/362; 156/353; 156/366

[58] Field of Search ..... 242/58.1–58.5, 242/57, 75.51, 75.52; 156/350, 351, 353, 358, 366, 504, 510; 83/362, 361, 363, 358, 359

[56] References Cited

U.S. PATENT DOCUMENTS

| | | | |
|---|---|---|---|
| 3,516,617 | 6/1970 | Haner et al. | 242/58.2 |
| 3,746,272 | 7/1973 | Rotolo | 242/58.3 |
| 3,760,667 | 9/1973 | Maxev et al. | 83/362 X |
| 3,967,518 | 7/1976 | Edwards | 83/362 X |
| 4,177,960 | 12/1979 | Nakagawa | 242/58.3 |

*Primary Examiner*—John M. Jillions

*Attorney, Agent, or Firm*—Gerstman & Ellis, Ltd.

[57] ABSTRACT

An apparatus is provided for handling a web of material fed from a roll. When the roll is larger than a selected amount, a roll contacting belt contacts the outer surface of the roll to aid in rotating the roll. The roll contacting belt is speed-responsive to a tension sensing means. Once the roll decreases to the selected amount, the roll contacting belt is disengaged from the roll and a core brake controls the speed of the roll. This arrangement reduces web upsets caused by out of round new large rolls and eliminates telescoping due to the action of the belt against small diameter rolls. In the illustrative form of the invention, the apparatus provides a continuous supply of web material by handling a first roll from which web material is being fed through an infeed roller and a nip roller, and a second roll from which web material is fed after the web material of the first roll has expired. The speed of the first roll is controlled by the core brake and when the web from the first roll has almost expired, the roll contacting belt contacts the outer surface of the second roll to aid in its rotation. A web tension sensing means controls the speed of the infeed roller, which speed is transmitted to the roll contacting belt so that the speed of the web at the infeed roller and the speed of the roll contacting belt are matched. The web from the first roll is adhesively connected to the web from the second roll and then severed, while both webs are at the same speed. A system is disclosed for anticipating the inherent dealy time between the actuating signal for the severing operation and the actual severing of the web.

4 Claims, 4 Drawing Sheets

FIG. 1
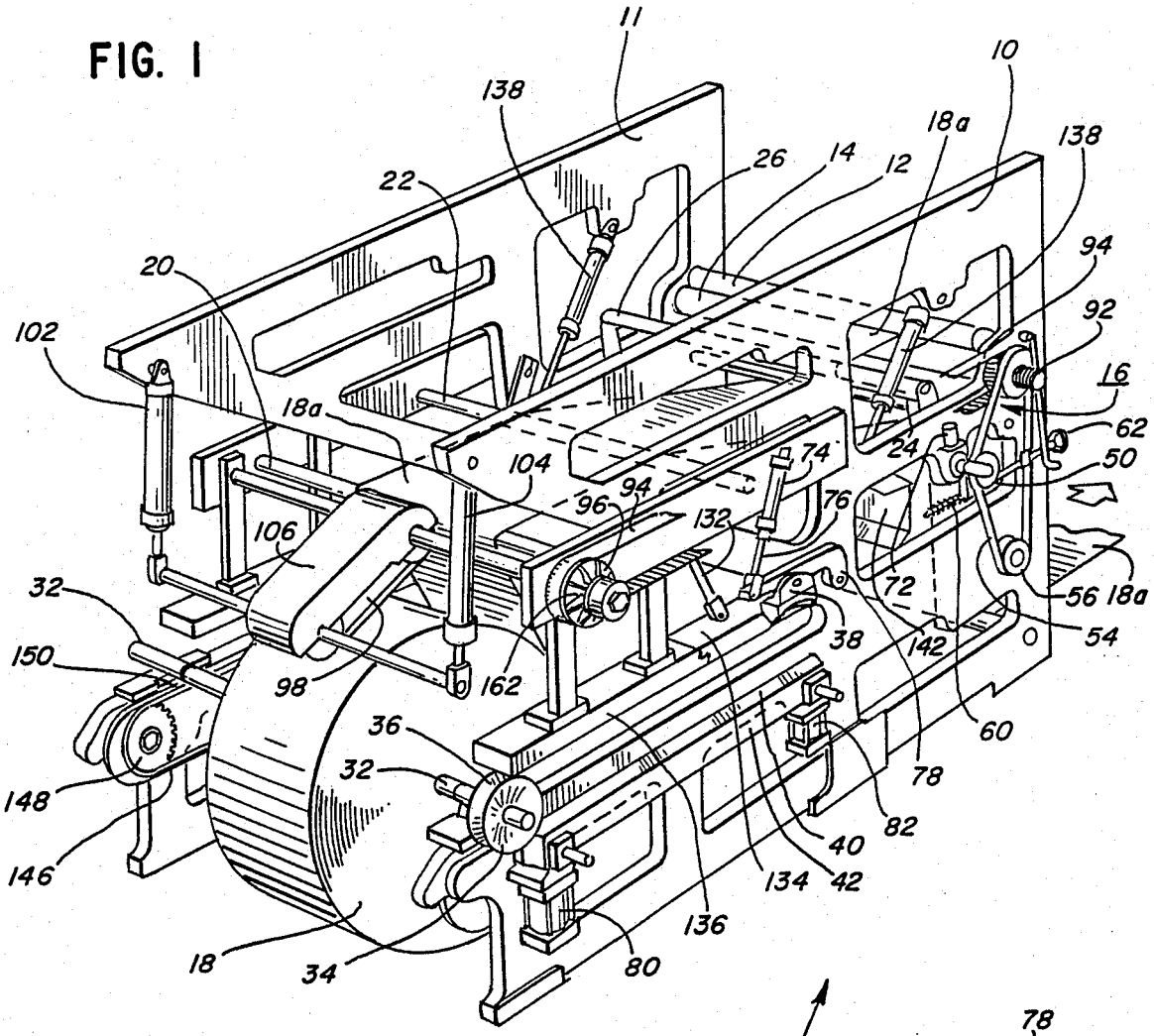
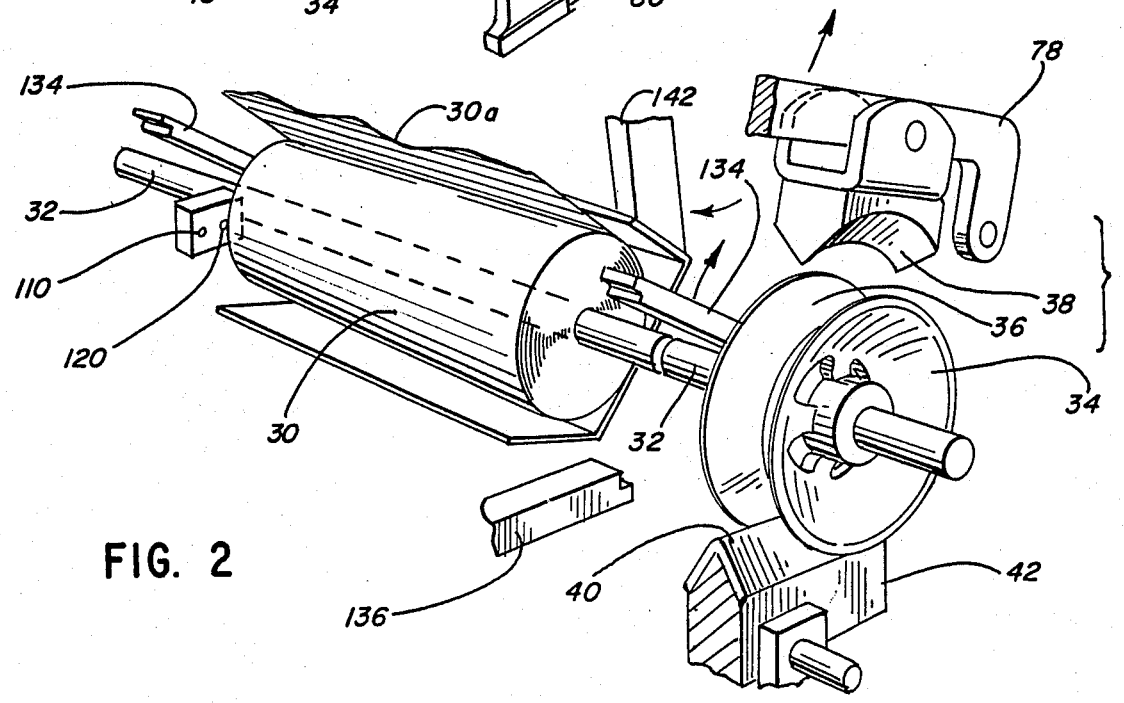
FIG. 2

APPARATUS AND METHOD FOR ACTIVATING A DEVICE FOR OPERATING ON A MOVING WORKPIECE

This application is a division of application Ser. No. 918,481, filed Oct. 14, 1986, now U.S. Pat. No. 4,729,519.

FIELD OF THE INVENTION

This invention concerns a system for handling a web of material from a roll, and, in the illustrative embodiment, a system for supplying a continuous, uninterrupted web of material. Although the illustrative embodiment concerns a paper web that is fed to a web printing system, it is to be understood that the present invention has more general applications.

BACKGROUND OF THE INVENTION

In Curran, et al. U.S. Pat. No. 4,173,314, an apparatus is disclosed for continuously supplying web material to a web printer. The web material is fed from a first roll that is supported in a feed position and, when the first roll is near depletion, the leading end of a second roll is adhesively connected to the web of the first roll with that web then being severed. A pair of parallel belts are employed for rotating both the forward and rearward rolls in order for both rolls to achieve the same speed for the connecting and severing operations. We have found that this prior art system does not work properly because the surface speeds of the first and second rolls are not the same when the rolls are of a different diameter. In addition, the paper from a roll tends to telescope when the roll diameter is relatively small and the wrap is not tight. If the belts apply a high pressure against the loose wrap, the chance of telescoping is even greater. If the belt tension is reduced in order to alleviate the telescoping problem, there may be slippage of the belts. There may also be a tracking problem because the belts are so long in that they are used to drive both of the rolls, and one of the belts may jump the pulleys.

Thus the prior art web supply apparatus discussed above has several disadvantages including problems in maintaining tension on the very long belts required, problems with belt tracking, tension upsets caused by the relative motion between the belts and the center line of the roll, and speed mismatches caused by differences in the distances that the belts contact the rolls or "wrap" which prevent an exact speed match between the expiring roll and the new roll.

It is desirable to have a system in which a continuous supply of web material may be supplied, with the disadvantages discussed above being alleviated. We have discovered an apparatus for supplying a continuous, uninterrupted web of material that does not require one or more belts for rotating both the forward and rearward rolls and thus does not have the problems described above.

Another problem that is found on high speed automatic machines, and web presses in particular, is the inherent delay between the time of a signal for a mechanism to activate and the time that the mechanism's function is completed. For example, the delay between the time that a signal is given for the knife to cut the expired web after it has been attached to the web from the new roll and the time that the cutting is actually completed may cause certain problems. In a high speed automatic splicer, it is necessary that the residual paper that remains attached to the new roll after the splice from the expired roll be kept as short as possible in order to reduce the probability of jamming the folder. The length of the glued area is approximately 15 inches and the overall length from the beginning of the paste to where the expired web was severed should be no more than 20 inches. Unfortunately, the delay time in the operation of the knife is typically equivalent to over two feet of paper. It is, therefore, necessary that the signal for the knife to cut the expired web be given at a time such that, irrespective of the delay in the knife firing, the cut will occur at the proper place. This anticipation of the signal time must be proportional to the speed of the machine with the anticipation being near zero at extremely low speeds and the full amount of the delay at high speeds. Previously, means to accomplish this anticipation have resulted in complex electronic devices using analog principles which have an inherent tendency to vary with temperatures, time, supply voltage, etc We have invented a system using timing means which are extremely accurate at any speed likely to be encountered on a printing press. Our invention anticipates the signal time but does not require complex electronic devices as required by prior art systems.

BRIEF DESCRIPTION OF THE INVENTION

In accordance with the present invention, an apparatus is provided for handling a web of material fed from a roll on a shaft. The apparatus includes means for supporting the shaft and means for sensing the tension of the web. An infeed roller is provided for feeding the web, with the infeed roller having a rotational speed that varies in response to the tension sensing means. A nipping roller is provided for pressing the web against the infeed roller to prevent slippage. A roll contacting belt contacts the outer surface of the roll and aids in rotating the roll. The roll contacting belt is driven in response to the tension sensing means. A brake drum is connected to the shaft and means are provided for variably engaging the brake drum in order to variably brake the rotation of the roll. Movement of the brake drum engaging means is responsive to the tension sensing means. The roll contacting belt is operated to control the rotation of the roll and thus the tension of the web when the roll is larger than a selected amount. Once the roll decreases to the selected amount, the predrive belt is disengaged from the roll and the brake drum engaging means operates to control the rotation of the roll.

In the illustrative embodiment, means are provided for transmitting the rotational speed of the infeed roller to the roll contacting belt driving means so that the speed of the web at the infeed roller and the speed of the roll contacting belt are matched. The means for sensing the tension of the web comprise a floating roller, a variable speed pulley for controlling the speed of the infeed roller, and a tension belt coupled to the variable speed pulley. Means are provided for varying the tension of the tension belt to vary the speed of the variable speed pulley in response to pivotal movement of the floating roller. The floating roller is in direct contact with the web and is operative to pivot in response to variable web tension.

In the illustrative embodiment, the brake drum engaging means is controlled in response to pivoting of the floating roller. The apparatus includes a cam that rotates in response to pivoting of the floating roller and the brake drum engaging means is operated by a pneumatic cylinder. A pressure regulating valve is controlled by the cam and the pneumatic cylinder is operated in response to the pressure regulating valve.

In accordance with the present invention, apparatus is disclosed for providing a continuous supply of web material. The apparatus includes a first roll from which web material may be fed, on a first shaft, and a second roll from which web material may be fed, on a second shaft. The first roll is located in front of the second roll and the web material from the second roll is used after the web material from the first roll has expired.

Means are provided for sensing the tension of the web being fed. An infeed roller is provided for feeding the web, with the infeed roller having a rotational speed that varies in response to the tension sensing means. A nipping roller presses the web against the infeed roller to prevent slippage.

A predrive belt is provided for contacting the outer surface of the second roll and for aiding in rotating the second roll. The predrive belt is driven in response to the tension sensing means.

First brake drum means are coupled to the first shaft and second brake drum means are coupled to the second shaft Means are provided for variably engaging the first brake drum means for variably braking the rotation of the first roll, with movement of the brake drum engaging means being responsive to the tension sensing means. Means are provided for operating the predrive belt to control the rotation of the second roll. In this manner, rotation of the first roll and thus the tension of the web from the first roll is controlled by the brake drum engaging means and the rotation of the second roll is controlled by the predrive belt when the predrive belt contacts the outer surface of the second roll.

In the illustrative embodiment, means are provided for transmitting the rotational speed of the infeed roller to the predrive belt driving means so that the speed of the web at the infeed roller and the speed of the predrive belt are matched, thereby matching the speed of the second web material with the speed of the first web material. Means are provided for connecting the second web to the first web and also means are provided for severing the first web after such connection.

In the illustrative embodiment, the brake drum engaging means comprises a linear brake surface and a curved brake surface downstream of the linear brake surface. The predrive belt is operated to control rotation of the second roll and thus aid in controlling the tension of the web when the second roll is larger than a selected amount. When the second roll decreases to the selected amount, the predrive belt is disengaged from the second roll and the brake drum engaging means is operated. In accordance with the invention, the second shaft is moved adjacent the linear brake surface and then to the curved brake surface. In this manner, tension of the web is first controlled by movement of the linear brake surface with respect to the brake drum and thereafter is controlled by movement of the curved brake shoe with respect to the brake drum.

In accordance with the present invention, a method is provided for activating a device for operating on a moving workpiece. For example, the moving workpiece may be a rotating roll of web material and the device may be a cutting device for cutting the web material. First, the inherent time delay between an activation signal and the time required for the device to operate on the moving workpiece is determined. A selected position of the workpiece is sensed. Index means are provided for indexing the travel of the workpiece. The index means are counted in a first count mode for a predetermined time after sensing the selected position. Thereafter, the index means are counted in a second count mode. An activation signal is provided when the predetermined number of counts has occurred. The first count mode comprises a function of the number of counts for each count of the second count mode.

In the illustrative embodiment, the predetermined time is substantially equal to the inherent time delay between the activation signal and the time required for the device to operate on the moving workpiece. The first count mode is twice the number of counts for each count of the second count mode.

A more detailed explanation of the invention is provided in the following description and claims, and is illustrated in the accompanying drawings.

BRIEF DESCRIPTION OF THE DRAWINGS

FIG. 1 is a perspective view of a web splicer apparatus constructed in accordance with the principles of the present invention, immediately after the expired roll has been removed;

FIG. 2 is a fragmentary enlarged perspective view of the chute and core brake arrangement enabling an expired roll to be removed from the apparatus;

DETAILED DESCRIPTION OF THE ILLUSTRATIVE EMBODIMENT

Figure 3:
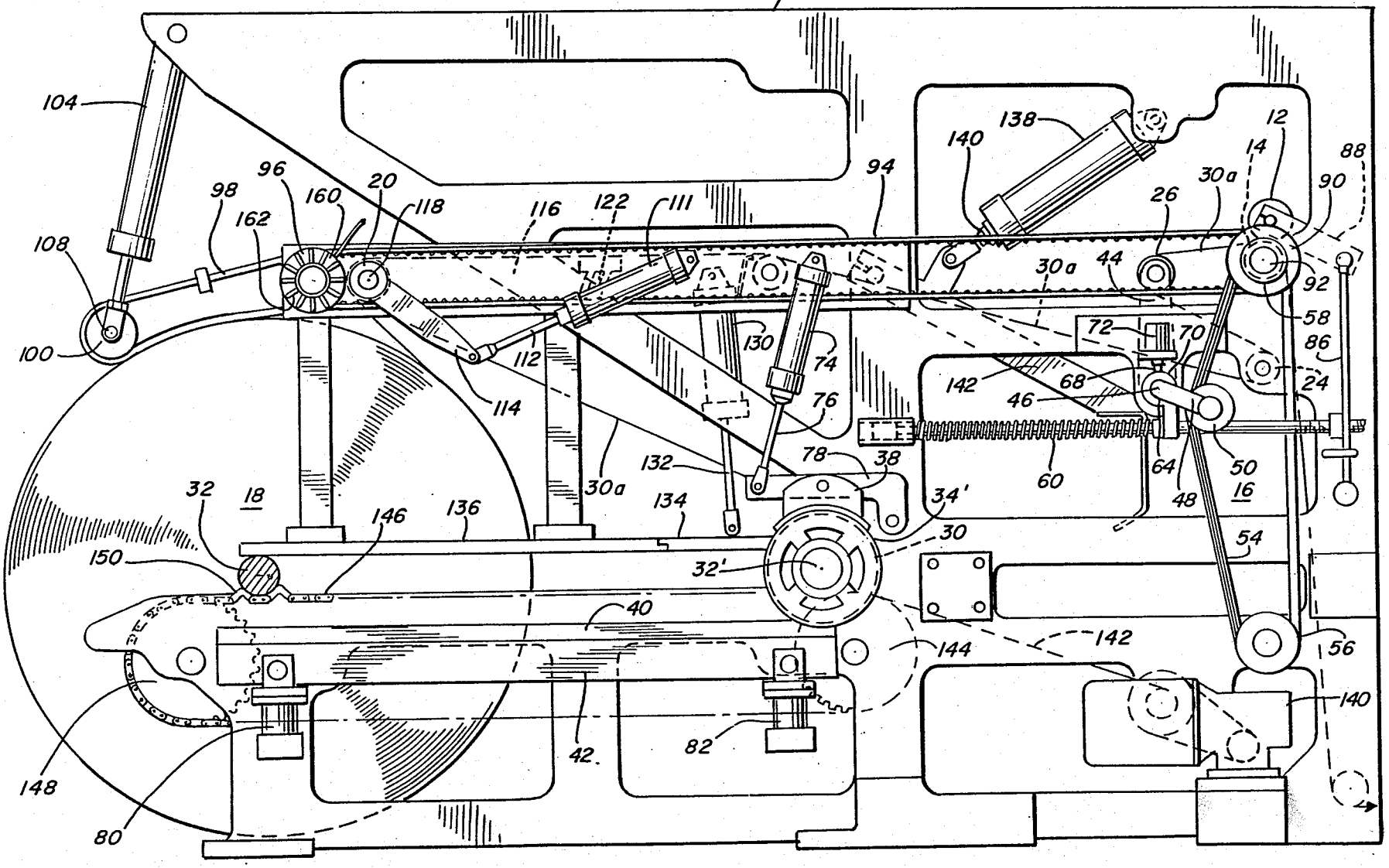
FIG. 3 is a side elevational view, which portions broken away for clarity, of the apparatus of FIG. 1, before the pasting and cutting operation.
Figure 4:
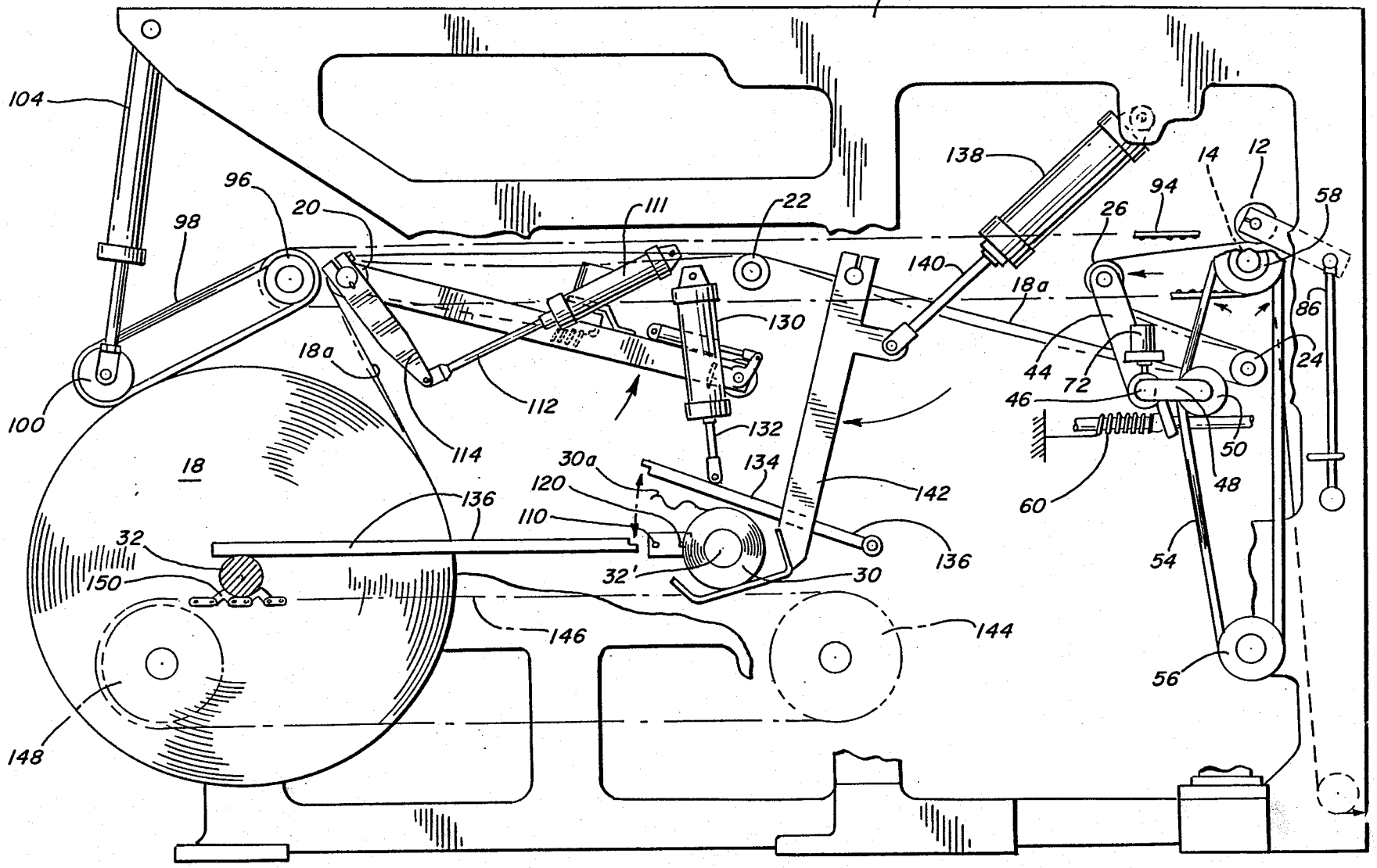
FIG. 4 is a side elevational view, similar to FIG. 3 but with other portions broken away for clarity, after the pasting and cutting operation.
Figure 5:
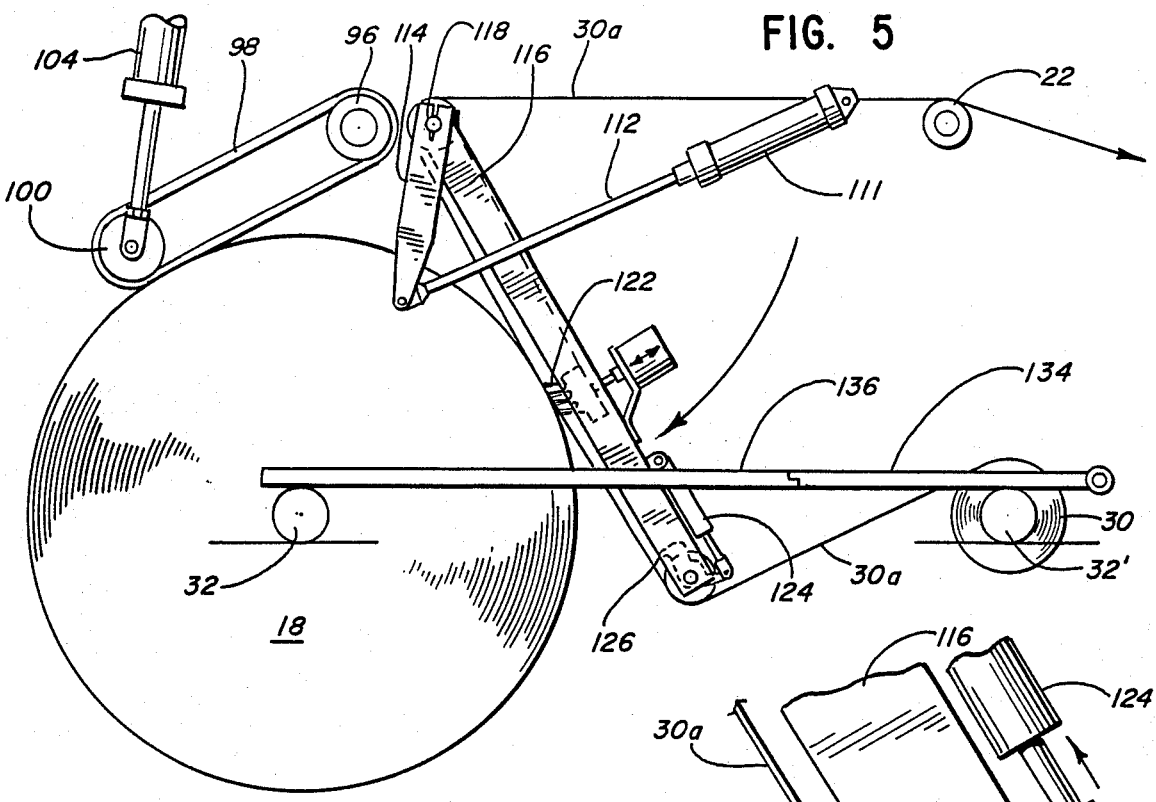
FIG. 5 is an elevational view of the brush/knife mechanism 116 in operation to connect the expiring web to the new web.

Referring to FIGS. 1 and 3, the apparatus of the present invention may be retrofitted into an existing Goss roll stand, and includes a right side frame 10, a left side frame 11, an elastomeric covered nip roller 12 extending between side frames 10 and 11, an infeed roller 14 also extending between side frames 10 and 11, a web tension adjustment mechanism 16 described in detail below, a new paper roll 18 which, in FIG, 1, has its web **18*a* extending over idler roller 20, idler roller 22 (see FIG. 3), under idler roller 24, around floating roller 26 and between infeed roller 14 and nip roller 12. While FIG. 1 illustrates the apparatus with only the new roll present and after an expired roll has been removed, FIG. 3 illustrates the apparatus with the old roll 30 in place shortly prior to its expiration and with web 30*a* being fed through the apparatus around rollers 20, 22, 24, 26 and between infeed roller 14 and nip roller 12. In FIG. 4, the apparatus is illustrated with web 18*a* of the new roll 18 being fed through the apparatus, and the path of the web 18*a* of paper roll 18** is most clearly illustrated.

New paper roll 18 surrounds a core shaft 32 to which a brake drum 34 is keyed. Brake drum 34 has a generally V-shaped interior 36 (FIG. 2) which cooperates with either brake shoe 38 or linear brake surface 40 of linear brake rail 42, or both, as is explained below. Likewise, old paper roll 30 surrounds a core shaft 32' to which a brake drum 34' is keyed.

The tensioning system 16 for the web is most clearly illustrated in FIGS. 3 and 4. It can be seen that the web travels over floating roller 26 which is rotatably connected to crank arm 44. Arm 44 is pivotable about fixed pivot 46 to which link 48 is also connected. The counterclockwise movement of roller 26 (as illustrated in FIG. 4) will result in counterclockwise movement of link 48, thereby effectively moving pulley 50 upward. This will cause an increase in the tension of belt 54, which is around idler pulley 56 and variable speed pulley 58. Variable speed pulley 58 comprises a pulley that is split down the middle with both halves being conical and held together under spring tension. When pulley 50 causes an increase in the tension of belt 54, the two halves of pulley 58, which are conical in shape, move apart and allow belt 54 to move in and coact with the variable speed pulley 58 at a smaller diameter, thus increasing the speed of variable speed pulley 58 and infeed roller 14 to which it is keyed. This operation is generally described in Huck U.S. Pat. No. 2,984,429.

The tension of floating roller 26 is adjusted by means of a floating roll tension spring 60 that is tension-variable by means of a tension adjustment handle 62. Floating roller 26 also serves to rotate cam 64 which pivots whenever floating roller 26, arm 44 and arm 48 pivot. Cam 64 has a camming surface 68 which engages the plunger 70 of a pressure regulator valve 72. Pressure regulator valve 72 is operative to control the pressure to pneumatic cylinder 74 which is the upper pneumatic brake cylinder for controlling the engagement of brake shoe 38 with brake drum 34. The distal end of piston 76 of cylinder 74 is connected to crank 78 which is fastened to core brake shoe 38 for lifting and lowering core brake shoe 38 in accordance with the movement of piston 76.

Pressure regulator valve 72 also controls lower brake cylinders 80, 82 which are fastened to linear brake rail 42 for causing upward and downward movement of the linear brake rail 42.

A spring steel member 86 is provided for biasing nip roller 12. Member 86 is connected to nip roller 12 through arm 88. Elastomeric covered nip roller 12 maintains the web pressed against infeed roller 14 and the tension in the web is maintained in accordance with the operation of tensioning system 16 cooperating with the braking system. For example, if the web tension begins to increase, floating roller 26 will pull to the right causing the pressure from pressure regulating valve 72 to cylinder 74 to decrease. This decrease in pressure causes the brake shoe 38 to back off the brake drum 34', resulting in a reduction in the tension of the web and allowing the floating roller 26 to return to its vertical or neutral position. Likewise, should the tension in the web decrease, floating roller 26 will move to the left, causing an increase in the pressure to cylinder 74 and thus more force on the brake shoe 38 coacting with brake drum 34.

At the same time that cam 64 is operating with respect to pressure regulator valve 16, the tension o belt 54 is being adjusted to vary the speed of variable speed pulley 58, as discussed above, thereby varying the speed of infeed roller 14 which is keyed to variable speed pulley 58. This also acts to control the web tension. Additionally, since the web is pressed tightly against infeed roller 14 by nip roller 12, the surface of the infeed roller 14 and the web speed are essentially identical and this gives a measure of the true velocity of the web. A feature of the present invention is to bring the speed of the new web **18*a* of the new paper roll 18 up to the speed of the present web 30*a* of the expiring paper roll 30. To achieve this result, a pulley 90 which is also keyed to shaft 92 of infeed roller 14 supports an endless belt 94 which drives clutch pulley 96. Clutch pulley 96 drives a predrive belt 98 which is connected to an idler pulley 100 that moves up and down in response to operation of pneumatic cylinders 102, 104. As illustrated in FIG. 1, predrive belt 9B is covered by safety cover 106 and pulley 100 is keyed to shaft 10B that extends from the piston of cylinder 102 to the piston of cylinder 104**.

Pneumatic cylinder 104 is operative to press predrive belt 98 against the surface of new paper roll 18 with sufficient force to prevent any relative motion between belt 98 and the surface of paper roll 18. It can be seen that belt 98 will move at the same speed as infeed roller 14 because the speed of shaft 92 of infeed roller 14 is being transmitted to clutch pulley 96 which drives belt 98. Since the speed of the expiring web **30*a* is equal to the speed of infeed roller 14, the surface speed of new paper roll 18, which has the same speed as belt 98, will be equal to the speed of web 30*a***. In this manner, at the time of the splice when the ne web is connected to the expiring web there is no tension upset or undue stress on the new web, even if the press is changing speed at the time of splice.

In this case, the "same speed" referred to with respect to the infeed roller 14 and the predrive belt 98 includes but is not limited to a fixed variance of less than 0.4%, with the predrive belt 98 being less than 0.4% slower than the infeed roller 14 to assure tension between the predrive belt 98 and the infeed roller 14.

Thus when the web **30*a* is operating from the old roll 30 in the manner illustrated in FIG. 3, the tension is being adjusted by brake shoe 38 on brake drum 30. A new roll 18 is in place at the left, waiting for a sensing signal that the old paper roll 30 is down to a predetermined diameter of, for example, 10 inches. To this end, a photoelectric sensor 110 (FIGS. 2 and 4) is provided which will issue a signal when old roll 30 is down to the predetermined diameter. At that time, cylinder 104 will be operated to bring predrive belt 98 into engagement with new roll 18. As the pressure of predrive belt 98 against the surface of new roll 18 increases, the predrive belt is engaged by an air clutch that slowly feathers the predrive belt from standstill up to the synchronous speed. Because the predrive belt 98 is slowly feathered up to speed, the grinding and tearing of the paper is avoided when the belt 98 comes into contact with the stationary new roll 18**.

Once the new roll 18 makes one revolution as a result of it being engaged by predrive belt 28, an electric eye that is looking at the surface of the new roll 18 provides a signal to cause pneumatic cylinder 111 to be actuated. The distal end of piston 112 of pneumatic cylinder 111 is coupled to a brush/knife bell crank 114 that causes the brush/knife carriage 116 to pivot about pin 118. As piston 112 extends, brush/knife carriage 116 will pivot counterclockwise with respect to FIGS. 3 and 4. The brush and knife carriage will be pivoted to a position in which the carriage almost touches new roll 1B.

Figure 6:
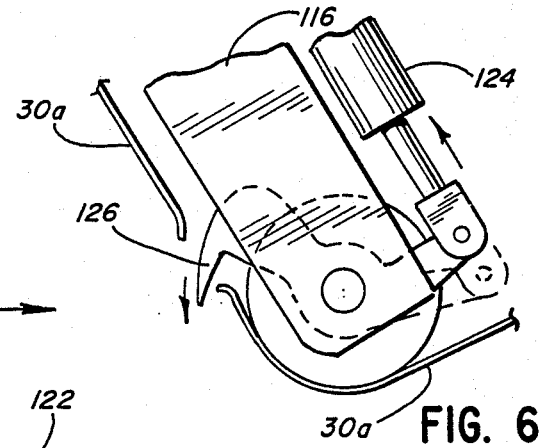
FIG. 6 is an enlarged fragmentary view of the cutting knife mechanism of FIG. 5.

As illustrated in FIGS. 2 and 4, an electric eye 120 is positioned adjacent old roll 30 and when old roll 30 is 4½ inches in diameter, electric eye 120 will signal the brush/knife carriage to swing down as illustrated in FIG. 4, in which the brush 122 presses the old web 30*a* into contact with the surface of the new roll 18 shortly after adhesive is applied to the surface of new roll 18 under where the brush pressure will be. The splice is now made and shortly thereafter piston 124 will be actuated to pivot knife 126 so as to sever the old web 30*a* downstream of but close to the splice. This is illustrated in FIG. 6.

Once the cut is made by knife 126, old roll 30, which is under the control of core brake shoe 38, will stop immediately. The web will now be drawn from new roll 18. The web 18*a* from new roll 18 is at the same speed as the web 30*a* from old roll 30 was as a result of the transmission of the speed of infeed roller 14 via belt 94 to predrive belt 98. Predrive belt 98 will continue to maintain contact with the surface of new roll 18 and will operate upon new roll 18 as a tension control device until the new roll is approximately two feet in diameter. Nip roller 12 cooperating with infeed roller 14 will serve to press the two webs with the adhesive between thus assuring a good bond.

During the time that speed of the new roll 18 is controlled by belt 98, the old roll 30 will be removed. To this end, air cylinder 130 will be actuated to withdraw its piston 132 to thereby pivot portion 134 of hold-down bar 136, as illustrated most clearly in FIG. 4 Pneumatic cylinder 138 has the distal end of its piston 140 connected to discharge chute 142 So that air cylinder 138 can then be actuated to pivot discharge chute 142 under old roll 30 and lift old roll 30 upward. With portion 134 of hold-down bar 136 pivoted upward as illustrated in FIGS. 2 and 4, and with chute 142 lifting old roll 30 upward as illustrated in FIGS. 2 and 4, the old roll 30 can now be withdrawn out of the right side frame of the apparatus.

When new roll 18 is down to about two feet in diameter, an electric eye will signal the energization of roll forwarding gear motor 140 (FIG. 3). Motor 140 drives chain 142 which drives sprocket 144 to move roll forwarding chain 146 around roll forwarding sprocket 148 in the clockwise direction with respect to FIG. 3. Chain 146 has pusher means 150 within which shaft 32 of new roll 18 is supported. Movement of roll forwarding chain 146 will thus cause concomitant movement of shaft 32 and its associated new roll 18. New roll 18 will be moved forward to the position that old roll 30 was in, in which core brake shoe 38 engaged core brake drum 34. However, during the travel of the new roll 18 from the left-hand side of FIG. 3, where it is under the control of belt 98, to the position where the brake drum 34 is engaged by brake shoe 38, the tension of the web is adjusted by means of the linear brake surface 40 of linear brake rail 42 (see FIGS. 2 and 3). As stated previously, tension is controlled by pneumatic cylinders 80 and 82 which cause linear brake rail 42 to move up and down in response to control by the pressure regulating valve 72 that is controlled by cam 64. Lower shaft hold-down bar 136 operates to prevent the core shaft 32 from moving upwardly and thus the tension control is maintained in accordance with the engagement of linear brake surface 40 with the inside 36 of brake drum 34. As illustrated in FIG. 2, linear brake surface 40 is formed of a relatively soft brake material, similar to the material forming brake shoe 38 and has a configuration that is complementary to the inside 36 of brake drum 34.

Once the new roll 18 has moved right to the right so that brake drum 34 underlies brake shoe 38, air cylinder 74 is actuated to pivot brake shoe 38 into engagement with brake drum 34. Once brake shoe 38 is engaging brake drum 34, air cylinders 80 and 82 will move linear brake rail 42 downward to allow the brake shoe 38 to take over as the tension control means.

The surface of a new roll of paper (40 inches in diameter or larger) is many times not concentric, as a result of sitting on the floor or mishandling with roll clamp truck. Thus the outer surface of a new roll of paper has peaks and valleys. By using the predrive belt 98 while the new roll is large, predrive belt 98 acts in the same manner as a tank track, adapting itself to variations in the outer surface of the new roll, avoiding the sending of sudden shocks through the tension system and, hence, web breaks. The core brake system on a new roll, as opposed to a belt tension system on a new roll, has no way of absorbing the shocks it generates from variations in the outer surface of the new roll. Therefore, it has been found that the belt-type system as described herein is most ideal for controlling tension on large new rolls.

However, when the new roll is reduced to approximately two feet in diameter, the belt type of tension loses its effectiveness. The roll of paper is now fully concentric, having passed the variations of the outer surface through the press. A belt system, under these circumstances, may cause telescoping of the web. We have found that at this point, a core brake system is the most ideal system for handling partially unwound rolls.

It can thus be seen that there are three manners in which tension is controlled. When the new roll 18 is large, predrive belt 98 controls the surface velocity of the new roll. This reduces web upsets caused by out of round new, large rolls and alleviates the telescoping problem of the prior art resulting from the action of a large belt against nearly expired small diameter rolls. By using an air clutch, the predrive belt 98 is stationary when it contacts the stationary new roll but is feathered up to synchronous speed, thus eliminating a scuffing of the surface. Thus once the new roll has been used so that its diameter is such that continuing contact of the predrive belt 98 with the surface of the new roll might cause telescoping, air cylinder 104 is actuated to remove belt 98 from the surface of new roll 18 and the tension of the new roll is now under the control of a linear core brake. The braking force has very gradually been transferred from predrive belt 98 to the linear core brake. As the new roll moves to its final position (to become an "old roll"), linear brake surface 40 takes over tension control. Once new roll 18 is moved forward and assumes the position of an "old roll," curved brake shoe 38 which provides considerable area contact with interior 36 of brake drum 34, takes over.

Figure 7:
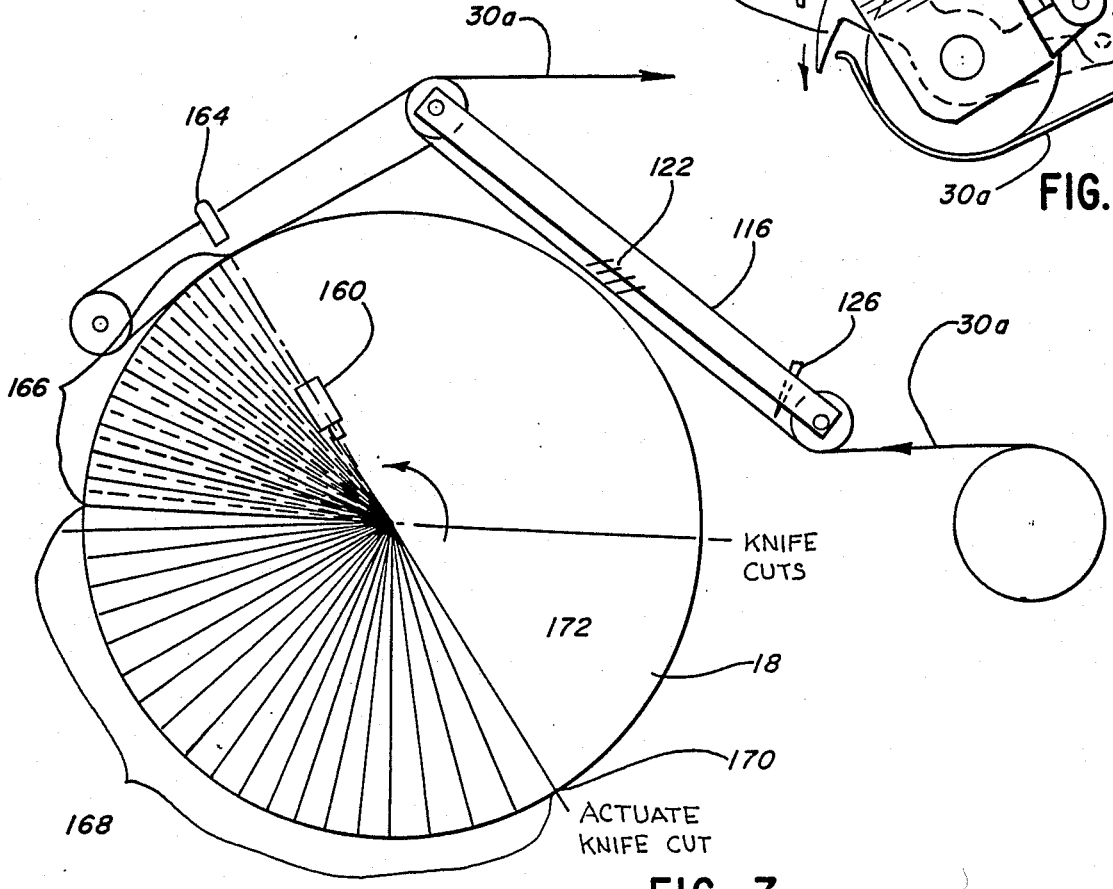
FIG. 7 is a diagrammatic view of a knife carriage actuation system in accordance with the principles of the present invention.

FIG. 7 illustrates, in diagrammatic form, how the knife signal is provided so that the knife 126 will cut the expired web 30*a* at the desired place, notwithstanding a delay that is inherent between the time that a signal is given for the knife mechanism to activate and the time that the cutting function is complete. As previously stated, it is necessary that the residual portion of the old web 30*a* that remains attached to the new web 18*a* after the splice from the old roll 30 be kept as short as possible in order to reduce the probability of jamming the folder. The delay time between the time a signal is given for the knife mechanism to activate and the time that the cutting is complete may be equivalent to over two feet of residual paper. In accordance with the present invention, a system is provided for anticipating this time delay. To this end, a magnetic sensor 160 is provided which is inductively coupled to radial teeth 162 (FIG. 3) of driven clutch pulley 96. A mark detector 164 (FIG. 7) is provided to sense a glue mark that has been applied to the surface of the new roll 18. When the glue mark is sensed by sensor 164, a counter starts counting the teeth 162 in a "double mode" during a predetermined time period. Thus assume that there is normally a delay of X milliseconds between the time the signal is provided for the knife to cut and the actual time that the knife cuts the web. During those X milliseconds, a counter will count the teeth sensed by sensor 160 twice as fast as normal, i.e., two counts per tooth. After the X milliseconds, the counter will count the teeth in a normal mode, i.e., one count per tooth. To achieve this, either two counts may be provided every time a tooth 162 passes the magnetic sensor during the X milliseconds or two magnetic sensors could be used to double the count during the X milliseconds. After X milliseconds have passed, there will be only one count for every time a tooth passes the magnetic sensor 160 because the system will then be on one-to one count ratio. To understand the system clearly, the following example is given and reference is made to FIG. 7.

Since predrive belt 98 determines the rotation of new roll 1B, and since predrive belt 98 is driven by pulley 96 which carries teeth 162, it can be seen that the amount of rotation of new roll 18 is directly proportional to the number of teeth 162 that have passed the magnetic sensor 160. Assume that once the glue mark is detected by detector 164, a knife cut is desired after a 240 degrees rotation of new roll 18 and assume that a 240 degrees rotation of new roll 18 is equal to one thousand teeth passing sensor 160. Also assume that it is known that the delay inherent between the signal to the knife and the actual cut is 60 milliseconds. Then, once detector 164 detects the glue mark, for 60 milliseconds each tooth will be counted as two teeth. This is shown on arc 166 of FIG. 7 which corresponds to 60 milliseconds of travel. Thus if 250 teeth have passed sensor 160, there will be a count of 500. Arc 168 of FIG. 7 illustrates the balance of the counts to total 1,000 counts. In this manner, after 500 more teeth have passed magnetic sensor 160, the counter will have counted up to 1,000 and the signal will be given at point 170 to actuate the knife cut. There will be a 60-millisecond inherent delay which corresponds to arc 172 of FIG. 7 and the knife will then cut.

In effect, 60 milliseconds of counts have been subtracted from the total count. In the illustrative embodiment, the 60 milliseconds of counts was equal to 250 teeth, and by doubling the count during the first 250 teeth there is an automatic subtraction of the 60 millisecond delay, thereby anticipating the knife cut by 60 milliseconds.

The 60 millisecond delay is calibrated by running the roll 18 at its fastest speed so that it is determined that the maximum amount of paper will run through at 60 milliseconds. If the machine is operated very slowly, a much less number of counts will be subtracted from the total, anticipating proportionally later at slow speeds. In any event, the knife will always fire at substantially the same point on the expired web irrespective of the speed of the new roll.

Although an illustrative embodiment of the invention has been shown and described, it is to be understood that various modifications and substitutions may be made by those skilled in the art without departing from the spirit and scope of the present invention.

What is claimed is:

1. Apparatus for activating a device for operating on a moving workpiece, which comprises:

means for sensing a selected position of the workpiece;

means for indexing the travel of the workpiece;

means for detecting said indexing means;

counting means, coupled to said detecting means, for counting the index means;

means, for operating said counting means to count the index means in a first count mode for a predetermined time after said sensing means senses said selected position;

means for operating said counting means to count the index means in a second count mode after said predetermined time;

means for providing an activation signal when a predetermined number of counts has occurred;

said predetermined time being substantially equal to the inherent time delay between said activation signal and the time required for the device to operate on the moving workpiece, and the first count mode being a multiple of the number of counts for each count of the second count mode.

2. A method for activating a device for operating on a moving workpiece, which comprises the steps of:

determining the inherent time delay between an activation signal and the time required for the device to operate on the moving workpiece;

sensing a selected position of the workpiece;

providing indexing means for indexing the travel of the workpiece;

counting the index means in a first count mode for a predetermined time after sensing the selected position;

thereafter counting the index means in a second count mode;

providing an activation signal when a predetermined number of counts has occurred;

said predetermined time being substantially equal to the inherent time delay between the activation signal and the time required for the device to operate on the moving workpiece, and the first count mode being a multiple of the number of counts for each count of the second count mode.

3. Apparatus for activating a cutting knife for operating on a rotating roll of web material, which comprises:

means for sensing a selected position of the web;

means for indexing the travel of the web;

means for detecting said indexing means;

counting means, coupled to said detecting means, for counting the index means;

means for operating said counting means to count the index means in a first count mode for a predetermined time after said sensing means senses said selected position;

means for operating said counting means to count the index means in a second count mode after said predetermined time;

means for providing an activation signal when a predetermined number of counts has occurred;

said first count mode comprising a function of the number of counts for each count of the second count mode.

4. Apparatus as described in claim 3, in which the indexing means comprises a plurality of teeth which rotate at a speed proportional to the rotational speed of the roll of web material, said detecting means comprising inductive means for sensing the relative movement of the teeth adjacent said inductive means; and said sensing means comprises means for sensing a glue mark on the roll.

* * * * *